US008851343B1

(12) United States Patent
Evans et al.

(10) Patent No.: US 8,851,343 B1
(45) Date of Patent: Oct. 7, 2014

(54) WEARABLE SUPPORT STRUCTURE THAT SUPPORTS A SUN SHADE ON OR ABOVE A USER

(75) Inventors: Joseph W. Evans, Houston, TX (US); Robert G. Gottlieb, Houston, TX (US)

(73) Assignee: Joseph W. Evans, Houston, TX (US)

( * ) Notice: Subject to any disclaimer, the term of this patent is extended or adjusted under 35 U.S.C. 154(b) by 277 days.

(21) Appl. No.: 13/568,936

(22) Filed: Aug. 7, 2012

(51) Int. Cl.
*A45B 11/02* (2006.01)

(52) U.S. Cl.
CPC ..... *A45B 11/02* (2013.01)
USPC ..... 224/190; 224/187; 135/20.1

(58) Field of Classification Search
CPC ..... A45F 3/04; A45F 3/08
USPC ..... 224/186–190; 135/20.1, 120.3, 96; 2/410
See application file for complete search history.

(56) References Cited

U.S. PATENT DOCUMENTS

| | | | | | |
|---|---|---|---|---|---|
| 288,115 | A * | 11/1883 | Ray | 2/410 |
| 578,572 | A * | 3/1897 | Lashells | 224/189 |
| 587,460 | A * | 8/1897 | Speer | 224/187 |
| 616,903 | A * | 1/1899 | Crocker | 2/410 |
| 753,107 | A * | 2/1904 | Pinchback | 224/187 |
| 1,469,111 | A * | 9/1923 | Russell | 224/187 |
| 1,627,847 | A * | 5/1927 | Harold | 224/187 |
| 1,803,538 | A * | 5/1931 | Pistole | 224/187 |
| 2,434,526 | A * | 1/1948 | Thornton | 135/16 |
| 2,478,268 | A * | 8/1949 | Hudson | 224/187 |
| 3,840,161 | A * | 10/1974 | Boggs et al. | 224/161 |
| 4,170,242 | A * | 10/1979 | Caso | 2/410 |
| 4,179,053 | A * | 12/1979 | Figura | 224/190 |
| 5,695,100 | A * | 12/1997 | O'Brien | 224/160 |
| 5,934,529 | A * | 8/1999 | O'Brien | 224/160 |
| 6,024,264 | A * | 2/2000 | Java | 224/576 |
| 6,076,539 | A * | 6/2000 | Richardson | 135/20.1 |
| 8,690,031 | B1 * | 4/2014 | Blakley et al. | 224/190 |
| 8,727,190 | B2 * | 5/2014 | Blair | 224/153 |
| 2007/0262103 | A1 * | 11/2007 | Blakley et al. | 224/190 |

* cited by examiner

*Primary Examiner* — Brian D Nash
*Assistant Examiner* — Corey Skurdal
(74) *Attorney, Agent, or Firm* — Plager Schack LLP; Michael O'Brien

(57) ABSTRACT

A platform supports a sun shade that can keep a user cool in the sun. The platform comprises a sun shade mechanically coupled to four rods by a series of rod connections. Each rod is inserted into a separate tube with its movement restricted by rod lock. Two tubes are mechanically coupled to a right adjustable shoulder strap. Two tubes are mechanically coupled to a left adjustable shoulder strap. A user can place the left adjustable shoulder strap and the right adjustable shoulder strap on shoulders of the user to provide increased stability to the sun shade.

8 Claims, 4 Drawing Sheets

WEARABLE SUPPORT STRUCTURE THAT SUPPORTS A SUN SHADE ON OR ABOVE A USER

FIELD OF THE INVENTION

This invention relates to devices to protect a user from the sun and to keep the user cool.

BACKGROUND OF THE INVENTION

Bright sunlight in hot temperate environments directed on the human body can lead to health problems such as dehydration, heat exhaustion, heat stroke, and skin cancer. The time people spend in this environment is dramatically limited when no shade is present.

Prior art sun shades feature a single post attached to the body that runs extremely close to the user's head, thereby restricting head movement. The single post sun shade design exhibits inferior functional stability. When a fan is attached to the single post sun shade design, the fan has a tendency to shift away from the desired direction due to an imbalanced force moment that causes the post to twist. Large brimmed hats provide shade but block convective head-cooling winds and trap body heat escaping from around the head which is the main method of heat transfer from the body to the cooler ambient air.

The present invention solves these problems with a criss-crossed pole design that significantly increases lateral and longitudinal stability when compared to the single offset post design. The present invention can produce sun shade on the entire body compared to large brimmed hats which have a much small coverage area. It also provides a hstable platform to attach solar panels and solar or battery powered fans better than the single post design by transferring the new torque forces to the waistband, eliminating shade twisting, and reducing shade wobble.

BRIEF SUMMARY OF THE INVENTION

A platform supports a sun shade that can keep a user cool in the sun. The platform comprises a sun shade mechanically coupled to four rods by a series of rod connections. Each rod is inserted into a separate tube with its movement restricted by rod lock. Two tubes are mechanically coupled to a right adjustable shoulder strap. Two tubes are mechanically coupled to a left adjustable shoulder strap. A user can place the left adjustable shoulder strap and the right adjustable shoulder strap on shoulders of the user to provide increased stability to the sun shade.

BRIEF DESCRIPTION OF THE SEVERAL VIEWS OF THE DRAWINGS

Figure 1:
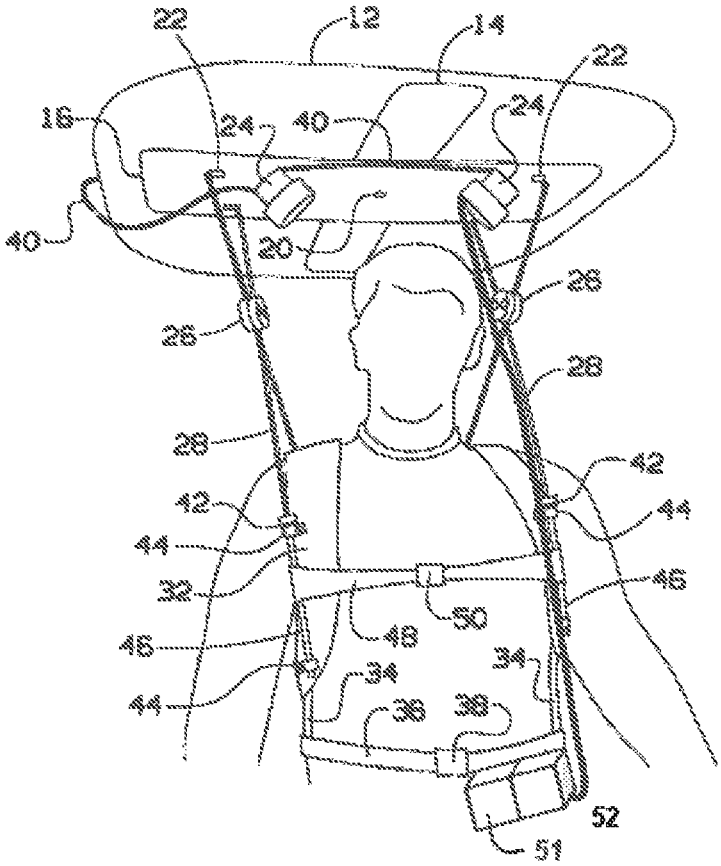

Having thus described the invention in general terms, reference will now be made to the accompanying drawings, which are not necessarily drawn to scale, and wherein:

FIG. 1 is a perspective view of the invention shown in use.

Figure 2:
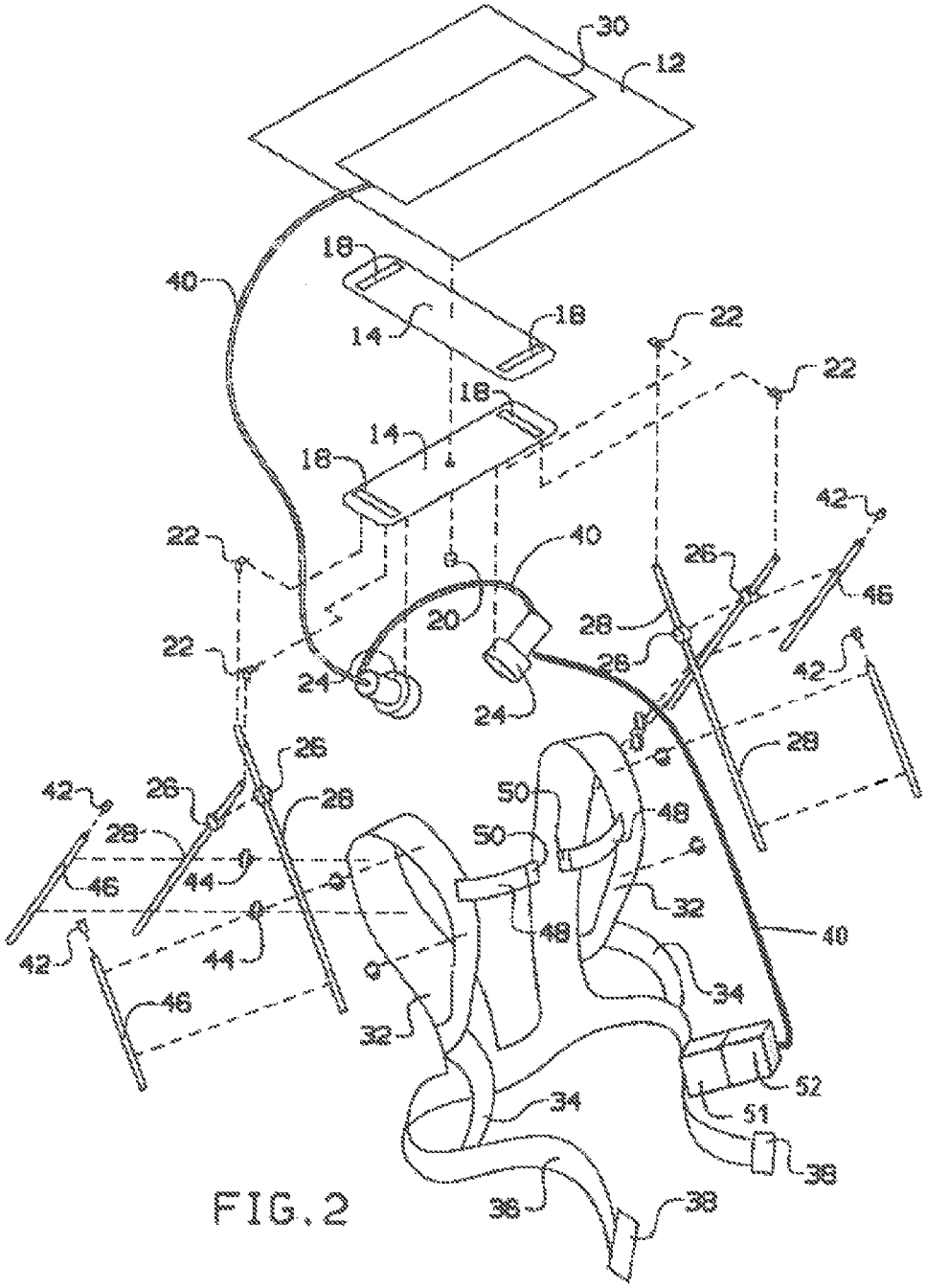

FIG. 2 is an exploded view of the invention.

Figure 3:
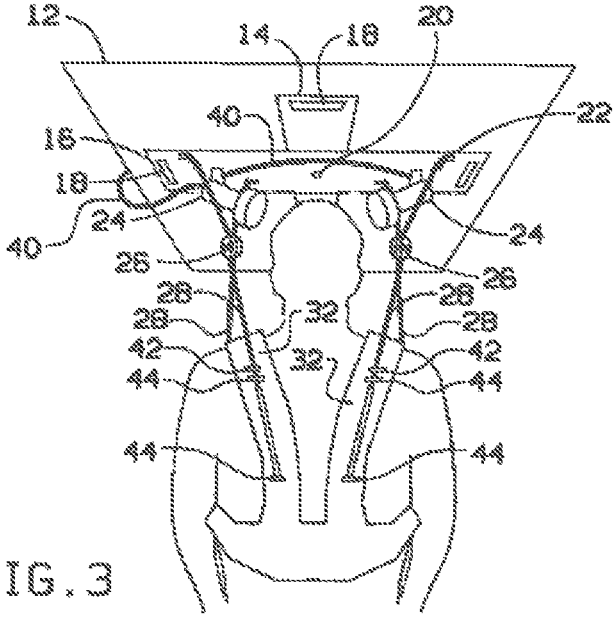

FIG. 3 is a rear view of the invention.

Figure 4:
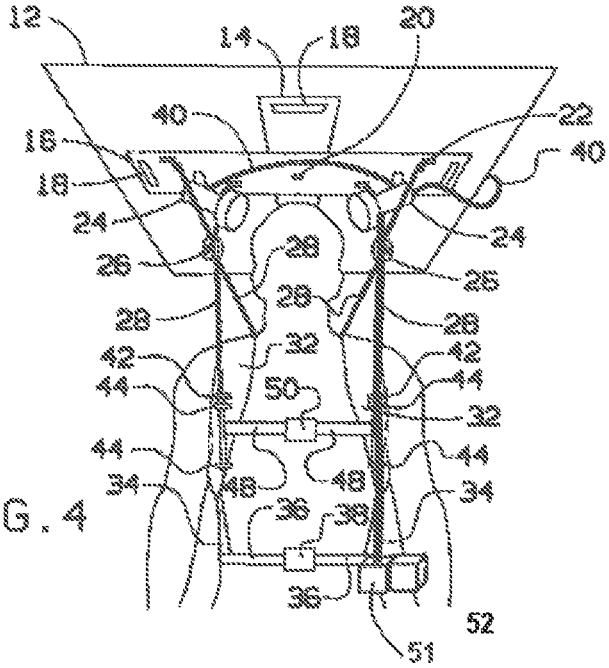

FIG. 4 is a front view of the invention.

Figure 5:
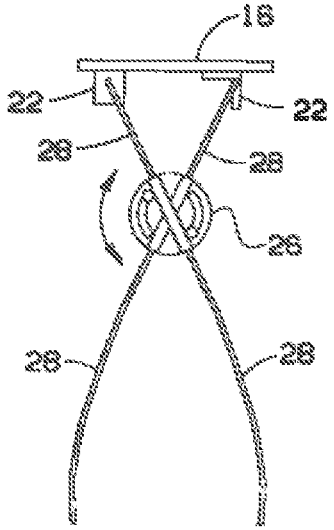

FIG. 5 is a side view illustrating the upper section of the rod attachment.

Figure 6:
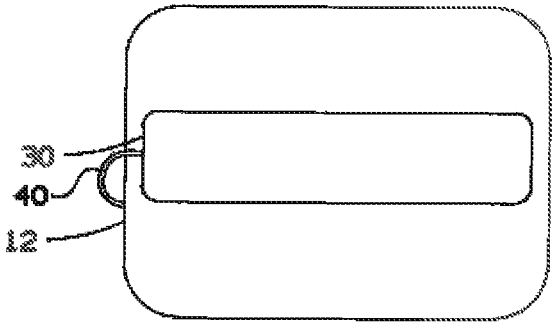

FIG. 6 is a detailed top view illustrating the solar panel.

DETAILED DESCRIPTION OF THE INVENTION

Embodiments of the present invention overcome many of the obstacles associated with keeping cool and protected from the sun, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows a wearable support structure in use. A user desires to be shaded and cooled from ambient heat and light and solves this problem with the hands-free platform supporting a sun shade, solar panel, battery, charger, controller, and fan. Sun shade 12 is mechanically coupled to solar panel 30.

Sun shade 12 is mechanically coupled to a wearable support structure in the following manner. Sun shade 12 is mechanically coupled to top shade support 14 by top attachment 18 and bottom shade support 16 by bottom attachment 18. Top shade support 14 and bottom shade support 16 are mechanically coupled to sun shade 12 by swivel support attachment 20. Bottom shade support 16 and top shade support 14 are allowed to swivel to and from a collapsed to expanded configuration in a scissor-like manner putting the device in a collapsed configuration. Sun shade 12 is mechanically coupled to solar panel 30 as shown in FIG. 6.

Bottom shade support 16 is mechanically coupled to first right rod 28, second right rod 28, first left rod 28 and second left rod 28 by the rod-to-shade support attachments 22 as shown in FIG. 2, FIG. 3 and FIG. 4. First right rod 28 is attached to first right tube 46 and can be moved in and out of first right tube 46; first right rod 28 motion is limited by first right rod lock 46. Second right rod 28 is attached to second right tube 46 and can be moved in and out of second right tube 46; second right rod 28 motion is limited by second right rod lock 46. First left rod 28 is attached to first left tube 46 and can be moved in and out of first left tube 46; first left rod 28 motion is limited by first left rod lock 42. Second left rod 28 is attached to second left tube 46 and can be moved in and out of second left tube 46; second left rod 28 motion is limited by second left rod lock 42. In this manner, the wearable support structure is attached to sun shade 12, and sun shade 12 can be raised and lowered from the level of a user and above. This construction is shown in more detail in FIG. 2, FIG. 3 and FIG. 4.

One of the problems in the prior art solved by the present invention is the matter of stability of sun shade 12. In this matter, the user can extend sun shade 12 upward from the user to a desired position and then lock rods 28 into position with rod locks 42 as shown in Fig. FIG. 2, FIG. 3 and FIG. 4. The crisscross configuration of rods 28 through rod locks 42 provides additional stability. This problem is further solved by having a shoulder harness comprising adjustable shoulder straps 32, chest bands 48, adjustable side straps 34 and adjustable waistband 36. Depending on the wind and other environmental conditions some or all of these may be necessary to add stability to the platform.

Bottom shade support 16 is mechanically coupled to first right rod 28 by first right rod-to-shade support attachment 22. Bottom shade support 16 is mechanically coupled to second right rod 28 by second right rod-to-shade support attachment 22. First right rod 28 slides through a first section of a right rod attachment 26, likewise, second right rod 28 slides through a second section of the second right rod attachment 26. First left rod 28 slides through a first section of the first left rod attachment 26, likewise, second left rod 28 slides through a second section of the left rod attachment 26. The first section of the right rod attachment 26 is affixed to second section of the right rod attachment 26 to form right rod attachment 26 as shown in FIG. 2, FIG. 3, FIG. 4 and FIG. 5. Likewise, the first section of left rod attachment 26 is affixed to second section of the left rod attachment 26 to form left rod attachment 26.

Bottom shade support 16 is mechanically coupled to first left rod 28 by first left rod-to-shade support attachment 22. Bottom shade support 16 is mechanically coupled to second left rod 28 by second left rod-to-shade support attachment 22. First left rod 28 comprises first section of the left rod attachment 26, likewise, second left rod 28 comprises second section of left rod attachment 26. First section of left rod attachment 26 is coupled to second section of left attachment 26. The functionality of rod attachments 26 is shown in more detail in FIG. 5.

First right tube 46 is mechanically coupled to first right rod lock 42. First right tube 46 can be mechanically coupled to right shoulder strap 32 by upper first right tube attachment 44 and lower first right tube attachment 44. Second right tube 46 is mechanically coupled to second right rod lock 42. Second right tube 46 can be mechanically coupled to right shoulder strap 32 by upper second right tube attachment 44 and lower second right tube attachment 44.

First left tube 46 is mechanically coupled to first left rod lock 42. First left tube 46 can be mechanically coupled to left shoulder strap 32 by upper first left tube attachment 44 and lower first left tube attachment 44. Second left tube 46 is mechanically coupled to second left rod lock 42. Second left tube 46 can be mechanically coupled to left shoulder strap 32 by upper second left tube attachment 44 and lower second left tube attachment 44.

The shoulder harness comprises left adjustable shoulder strap 32 mechanically coupled to right adjustable shoulder strap 32. Left adjustable shoulder strap 32 is mechanically coupled to left adjustable side strap 34. Right adjustable shoulder strap 32 is mechanically coupled to right adjustable side strap 34.

Left adjustable shoulder strap 32 is mechanically coupled to left chest band 48. Left chest band 48 is attached to left chest attachment 50. Likewise, right adjustable shoulder strap 32 is mechanically coupled to right chest band 48. Right chest band 48 is attached to right chest attachment 50. Left chest attachment 50 can be mechanically coupled to right chest attachment 50 in a known manner. For example, left chest attachment 50 can be a hook fastener and right chest attachment 50 can be a loop fastener.

Right adjustable shoulder strap 32 is further mechanically coupled to a right adjustable waistband 36, which is further mechanically coupled to right waistband attachment 38. Likewise, left adjustable shoulder strap 32 is further mechanically coupled to a left adjustable waistband 36, which is further mechanically coupled to left waistband attachment 38. Left waistband attachment 38 can be mechanically coupled to right waistband attachment 38 in a known manner. For example, left waistband attachment 38 can be a hook fastener and right waistband attachment 38 can be a loop fastener.

In the preferred embodiment, adjustable shoulder straps 32, adjustable waistbands 36, and adjustable side straps 34 are made of webbing and can be mechanically coupled by sewing.

FIG. 3 and FIG. 4 show the expansionary ability of rods 28 in and out of tubes 46. As noted above, there are four tubes 46 and four rods 28, which are described collectively in this manner. A user can adjust the height and fore-to-aft and side-to-side angle of sun shade 12 based on user preference. To do this the user unlocks each rod lock 46 and then moves the sun shade to the desired height and angle. A user can further adjust the angles of the sun shade 12 by sliding the rods 28 through the rod-to-rod attachment 26. The adjustable shoulder straps 32, adjustable waistbands 36, and adjustable side straps 34 can be clasped in the front (FIG. 3) and there are no adjustments in the back (FIG. 4). Here chest attachment 50 and waistband attachment 38 are shown as a clasp with a female and male section similar to a belt, but any known fastener is effective.

FIG. 5 shows rod attachment 26 in more detail. As noted above, bottom shade support 16 is mechanically coupled to first right rod 28 by first right rod-to-shade support attachment 22 and to second right rod 28 by second right rod-to-shade support attachment 22. Rods 28 are flexible or shaped and can be slightly bent by rod-to-rod attachment 26 to adjust the angle of sun shade 12. The ability to adjust the angle of sun shade 12 is another improvement on the prior art.

FIG. 6 shows solar panel 30 from a top view. Solar panel 30 is electrically coupled to first fan 24 and second fan 24, battery 51 and the charger/panel/fan controller 52, by wire 40. Wire 40 is covered and attached using well known safety standards. Additionally, some embodiments may have solar panel 30 charge battery 51 which can then power first fan 24 and second fan 24 or any portable electronic device.

That which is claimed:

1. A wearable support structure that supports a sun shade on or above a user comprising, the sun shade is mechanically coupled to a top shade support by a top attachment and a bottom shade support by a bottom attachment where the bottom shade support is mechanically coupled to the wearable support structure;

the wearable support structure comprises:

a first left rod mechanically coupled to the bottom shade support by a first left rod-to-shade support attachment and further mechanically coupled to a left adjustable shoulder strap;

a second left rod mechanically coupled to the bottom shade support by a second left rod-to-shade support attachment and further mechanically coupled to the left adjustable shoulder strap;

a first right rod mechanically coupled to the bottom shade support by a first right rod-to-shade support attachment and further mechanically coupled to a right adjustable shoulder strap; and a second right rod mechanically coupled to the bottom shade support by a second right rod-to-shade support attachment and further mechanically coupled to the right adjustable shoulder strap;

the first right rod slides through a first section of a right rod attachment; the second right rod slides through a second section of the right rod attachment;

the first left rod slides through a first section of a left rod attachment; the second left rod slides through a second section of the left rod attachment;

the first section of the right rod attachment is affixed to the second section of the right rod attachment to form the right rod attachment;

the first section of the left rod attachment is affixed to the second section of the left rod attachment to form the left rod attachment;

in this manner, the first left rod and the second left rod crisscross through the left rod attachment on the left adjustable shoulder strap and the first right rod and the second right rod crisscross through the left rod attachment on the left adjustable shoulder strap allowing the user to wear the sun shade and providing support for the sun shade through a crisscross configuration.

2. The wearable support structure that supports the sun shade on or above the user of claim 1, the top shade support is mechanically coupled to the bottom shade support by a swivel support attachment that allows the top shade support to swivel horizontally and provide greater support to the sun shade; the swivel support attachment further enables the user to collapse the sun shade into a collapsed configuration.

3. The wearable support structure that supports the sun shade on or above the user of claim 1, the right adjustable shoulder strap is further mechanically coupled to a right adjustable waistband, which is further mechanically coupled to a right waistband attachment;

the left adjustable shoulder strap is further mechanically coupled to a left adjustable waistband, which is further mechanically coupled to a left waistband attachment; and the left waistband attachment can be mechanically coupled to the right waistband attachment in a known manner providing additional support for the wearable support structure.

4. The wearable support structure that supports the sun shade on or above the user of claim 1, the first right rod is attached to a first right tube and can be moved in and out of the first right tube; the first right rod motion is limited by a first right rod lock; the second right rod is attached to a second right tube and can be moved in and out of the second right tube; the second right rod motion is limited by a second right rod lock; the first left rod is attached to a first left tube and can be moved in and out of the first left tube; the first left rod motion is limited by a first left rod lock; the second left rod is attached to a second left tube and can be moved in and out of the second left tube; the second left rod motion is limited by a second left rod lock;

in this manner, the wearable support structure is attached to the sun shade via the first left tube, the second left tube, the first right tube and the second right tube, and the sun shade can be raised and lowered on or above the user.

5. The wearable support structure that supports the sun shade on or above the user of claim 1, the left adjustable shoulder strap is mechanically coupled to a left chest band;

the left chest band is attached to a left chest attachment;

the right adjustable shoulder strap is mechanically coupled to a right chest band;

the right chest band is attached to a right chest attachment;

the left chest attachment can be mechanically coupled to the right chest attachment in a known manner providing additional support for the wearable support structure.

6. The wearable support structure that supports the sun shade on or above the user of claim 1, the sun shade is mechanically coupled to a solar panel;

the bottom shade support is mechanically coupled to a fan;

the solar panel is electrically coupled to the fan such that the fan can provide additional cooling to the user.

7. The wearable support structure that supports the sun shade on or above the user of claim 1, the sun shade is mechanically coupled to a solar panel;

the bottom shade support is mechanically coupled to a first fan and a second fan;

the solar panel is electrically coupled to the first fan and the second fan such that the first fan and the second fan can provide additional cooling to the user.

8. The wearable support structure that supports the sun shade on or above the user of claim 1, the sun shade is mechanically coupled to a solar panel;

the bottom shade support is mechanically coupled to a first fan and a second fan;

the solar panel is electrically coupled to the first fan and the second fan and a battery such that the first fan and the second fan can provide additional cooling to the user.

* * * * *